US008890396B2

(12) United States Patent
Ernst et al.

(10) Patent No.: US 8,890,396 B2
(45) Date of Patent: Nov. 18, 2014

(54) SPARK PLUG FOR A GAS-OPERATED INTERNAL COMBUSTION ENGINE

(75) Inventors: Anko Ernst, Salem (DE); Udo Sander, Salem (DE); Mario Dittmann, Friedrichshafen (DE); Werner Niessner, Steinheim (DE); Alexander Schenk, Waiblingen (DE)

(73) Assignee: Federal-Mogul Ignition GmbH, Wiesbaden (DE)

( * ) Notice: Subject to any disclaimer, the term of this patent is extended or adjusted under 35 U.S.C. 154(b) by 375 days.

(21) Appl. No.: 12/969,245

(22) Filed: Dec. 15, 2010

(65) Prior Publication Data

US 2011/0148274 A1 Jun. 23, 2011

(30) Foreign Application Priority Data

Dec. 18, 2009 (DE) ..... 10 2009 060 110
Jan. 16, 2010 (DE) ..... 10 2010 004 851

(51) Int. Cl.
*H01T 13/20* (2006.01)
*H01T 13/46* (2006.01)
*H01T 13/54* (2006.01)

(52) U.S. Cl.
CPC ..... *H01T 13/467* (2013.01); *H01T 13/54* (2013.01)
USPC ..... 313/141; 313/140

(58) Field of Classification Search
CPC ..... H01T 21/02; H01T 13/20; H01T 13/32; H01T 13/39; H01T 13/52; H01T 13/54
USPC ..... 313/118–145
See application file for complete search history.

(56) References Cited

U.S. PATENT DOCUMENTS 6,064,144 A 5/2000 Knoll et al.
6,453,299 B1 9/2002 Wendkos
(Continued)

FOREIGN PATENT DOCUMENTS

CN 2825995 Y 10/2006
CN 101006255 A 7/2007
(Continued)

OTHER PUBLICATIONS

Machine translation of Niessner (DE 10144976).*
(Continued)

*Primary Examiner* — Andrew Coughlin
(74) *Attorney, Agent, or Firm* — Reising Ethington P.C.

(57) ABSTRACT

The invention relates to a spark plug for a gas-fired internal combustion engine, and Includes a metallic body, with an insulator fastened in the body. A central electrode, leads through the insulator and includes a protruding end of a precious metal alloy. An annular ground electrode is fastened to the body and surrounds the end of the central electrode which, at the inside thereof facing the central electrode is provided with a precious metal or with a precious metal alloy. The mutually facing surfaces of the central electrode and ground electrode formed by the precious metal or the precious metal alloy are coaxially disposed cylinder surfaces. A cap is provided and attached to the body and which, after installation of the spark plug into a combustion chamber of the internal combustion engine, shields the central electrode and the ground electrode from the combustion chamber. Together with the body of the spark plug, the central electrode forms an ante-chamber, in which the central electrode and the ground electrode are disposed. The cap having at least one opening, which enables a gas exchange between the ante-chamber and the space outside of the ante-chamber. According to the invention, a deviation of the cylinder surfaces from the ideal cylinder geometry is less than +−20 μm, and a deviation of the positions of the axes of the cylinder surfaces from their ideal coaxial position is less than +−50 μm.

18 Claims, 3 Drawing Sheets

(56) References Cited

U.S. PATENT DOCUMENTS

| | | | | |
|---|---|---|---|---|
| 6,724,132 | B2 | 4/2004 | Kanao | |
| 7,521,849 | B2 | 4/2009 | Havard et al. | |
| 7,659,655 | B2 | 2/2010 | Tozzi et al. | |
| 2005/0211217 | A1 | 9/2005 | Boley et al. | |
| 2007/0069618 | A1* | 3/2007 | Havard et al. | 313/141 |
| 2009/0066211 | A1 | 3/2009 | Hartmann et al. | |

FOREIGN PATENT DOCUMENTS

| | | | |
|---|---|---|---|
| CN | 101553661 | A | 10/2009 |
| DE | 25 30 368 | A1 | 1/1977 |
| DE | 2530368 | B2 | 1/1977 |
| DE | 19705372 | A1 | 2/1997 |
| DE | 10131391 | A1 | 2/2002 |
| DE | 101 44 976 | A1 | 3/2003 |
| DE | 10144976 | A1 | 4/2003 |
| DE | 103 26 269 | A1 | 1/2005 |
| DE | 102007042790 | A1 | 3/2009 |

OTHER PUBLICATIONS

Chinese Office Action dated Sep. 23, 2013, 9 pages.

* cited by examiner

SPARK PLUG FOR A GAS-OPERATED INTERNAL COMBUSTION ENGINE

The invention relates to a spark plug for a gas-fired internal combustion engine, comprising a metallic body, an insulator fastened in the body, a central electrode, which leads through the insulator and which, at the end thereof protruding over the insulator, is provided with a precious metal or with a precious metal alloy, an annular ground electrode, which is fastened to the body, surrounds the end of the central electrode provided with a precious metal or with the precious metal alloy, and which, at the inside thereof facing the central electrode, is provided with a precious metal or with a precious metal alloy, the mutually facing surfaces of the central electrode and ground electrode formed by the precious metal or the precious metal alloy being coaxially disposed cylinder surfaces, and comprising a cap, which is attached to the body and which, after installation of the spark plug into a combustion chamber of the internal combustion engine, shields the central electrode and the ground electrode from the combustion chamber and, together with the body of the spark plug, forms an ante-chamber, in which the central electrode and the ground electrode are disposed, the cap having at least one opening, which enables a gas exchange between the ante-chamber and the space outside of the ante-chamber. Such a spark plug is disclosed in DE 101 44 976 A1.

In this spark plug, the central electrode and the ground electrode do not protrude directly into the combustion chamber of the internal combustion engine, but into an ante-chamber configured at the front of the spark plug, the ante-chamber being connected to the combustion chamber of the internal combustion engine by one or more openings, by which a gas exchange is possible between the ante-chamber and the combustion chamber.

Such spark plugs, which are also referred to as pre-chamber spark plugs, are used for igniting lean fuel-air mixtures in stationary, gas-operated internal combustion engines. A lean fuel-air mixture exists when the lambda ratio of the air volume actually present in the combustion chamber to the air volume stoichiometrically required for complete combustion of the fuel is greater than 1, with lambda values of 1.3 to 1.8, and particularly of lambda=1.6 to 1.7 being desirable. During the compression stroke of the internal combustion engine, an ignitable mixture is introduced into the ante-chamber through the openings of the ante-chamber. The ante-chamber, according to the function thereof, is a precombustion chamber. The ignitable gas-air mixture flowing into the ante-chamber is ignited, initially in the ante-chamber, by an ignition spark generated between the central electrode and the ground electrode. The flame generated in the ante-chamber is thrown out of the ante-chamber due to the pressure of the combustion developing in the ante-chamber, through the openings of the ante-chamber, and ignites the lean fuel-air mixture present in the combustion chamber of the internal combustion engine outside of the ante-chamber.

The electrodes of a spark plug are subject to burn-off, which limits the service lives thereof. As a result of the burn-off, the distance between the electrodes of the spark plug increases. Spark plugs without ante-chamber have the possibility to readjust the electrode gap, thereby compensating for the burn-off. This possibility does not exist with spark plugs having ante-chambers. For this reason, the pre-chamber spark plugs are subject to the requirement of achieving the longest possible service life. It is thus also known from DE 101 44 976 A1 to produce the electrodes from platinum, a platinum alloy, iridium, or an iridium alloy, or to tip them therewith.

It is the object of the present invention to provide a further measure, which is suited to increase the service life of a pre-chamber spark plug.

SUMMARY OF THE INVENTION

The spark plug according to the invention comprises a metallic body, an insulator fastened in the body a central electrode, which leads through the insulator and which, at the end thereof protruding over the insulator, is tipped with a precious metal or with a precious metal alloy, an annular ground electrode, which is fastened to the body, surrounds the end of the central electrode provided with the precious metal or with the precious metal alloy, and which, at the inside thereof facing the central electrode, is provided with a precious metal or with a precious metal alloy, wherein the mutually facing surfaces of the central electrode and the ground electrode formed by the precious metal, or by the precious metal alloy, are coaxially disposed cylinder surface, and a cap, which is attached to the body and which, after the installation of the spark plug in an internal combustion engine, shields the central electrode and the ground electrode from the combustion chamber and, together with the body of the spark plug, forms an ante-chamber, wherein the cap has at least one opening, which enables a gas exchange between the ante-chamber and the space outside of the ante-chamber;

the deviation of the cylinder surfaces from the ideal cylinder geometry being less than +−20 μm and the deviation of the positions of the axes of the cylinder surfaces from the ideal coaxial position being less than +−50 μm.

The deviation of the width of the annular gap, measured in the radial direction, between the mutually opposing cylinder surfaces from a predetermined clearance is preferably less than +−75 μm. It has been shown that the service life an a pre-chamber spark plug can be extended to an unexpected and surprising degree by ensuring that the deviation of the mutually opposing cylinder surfaces, which are formed by the precious metal or a precious metal alloy, from the ideal cylinder geometry, and the deviation from the ideal coaxial position, remains below the claimed threshold values. This causes the roots of the ignition sparks to be distributed considerably more uniformly over the cylindrical electrode surfaces, which are made of a precious metal or of a precious metal alloy, than in the prior art, so that the electrode surfaces burn off more uniformly, and practically the entire electrode surfaces are available for burn-off. It is a particular advantage of the invention that this also applies when the electrode surfaces are increased as compared to the electrode surfaces of known pre-chamber spark plugs, whereby the amount of electrode material available for the inevitable burn-off can be increased even further. Preferably the size of the cylinder surface of the central electrode formed by the precious metal, or by the precious metal alloy, is at least 15 $mm^2$ and more preferably at least 30 $mm^2$. Even cylindrical electrode surfaces measuring more than 40 $mm^2$ can be implemented on the central electrode with functional reliability and the corresponding increase in the service life. For the opposing cylinder surface of the ground electrode, a size should be provided for, which, due to the larger diameter of the cylinder surface of the ground electrode, is accordingly larger than the cylinder surface formed at the central electrode from a precious metal or a precious metal alloy. The heights of the cylinder surfaces of the two electrodes are advantageously equal or approximately equal.

Initial tests have been successful in approximately doubling the service life of pre-chamber spark plugs of the type mentioned above using the invention.

The roughness of the mutually opposing cylinder surfaces is preferably kept small and limited to a maximum of 1.6 μm. This also provides a contribution to extending the service life.

In order to achieve the accuracy desired according to the invention, the central electrode is ground at least in the region of the cylinder surface made of precious metal or of a precious metal alloy. The corresponding cylinder surface, located opposite of the central electrode, of the ground electrode is preferably formed by a section cut from a drawn tube.

Advantageously, the central electrode and the ground electrode are provided with platinum or iridium, or with a platinum alloy or an iridium alloy, and particularly with a platinum-based alloy or with an iridium-based alloy.

The annular gap between the two cylinder surfaces of the central electrode and ground electrode formed by a precious metal, or a precious metal alloy, is preferably 0.25 mm to 0.35 mm.

The diameter of the central electrode may be larger than in the prior art, namely 2 mm to 8 mm, where the central electrode is provided with a precious metal tip or with a precious metal alloy tip. The inside diameter of the annular ground electrode is correspondingly larger.

BRIEF DESCRIPTION OF THE DRAWINGS

Two embodiments of the invention are illustrated schematically in the attached drawings. Identical or corresponding parts are denoted with the same reference numerals in the two embodiments.

DETAILED DESCRIPTION

Figure 1:
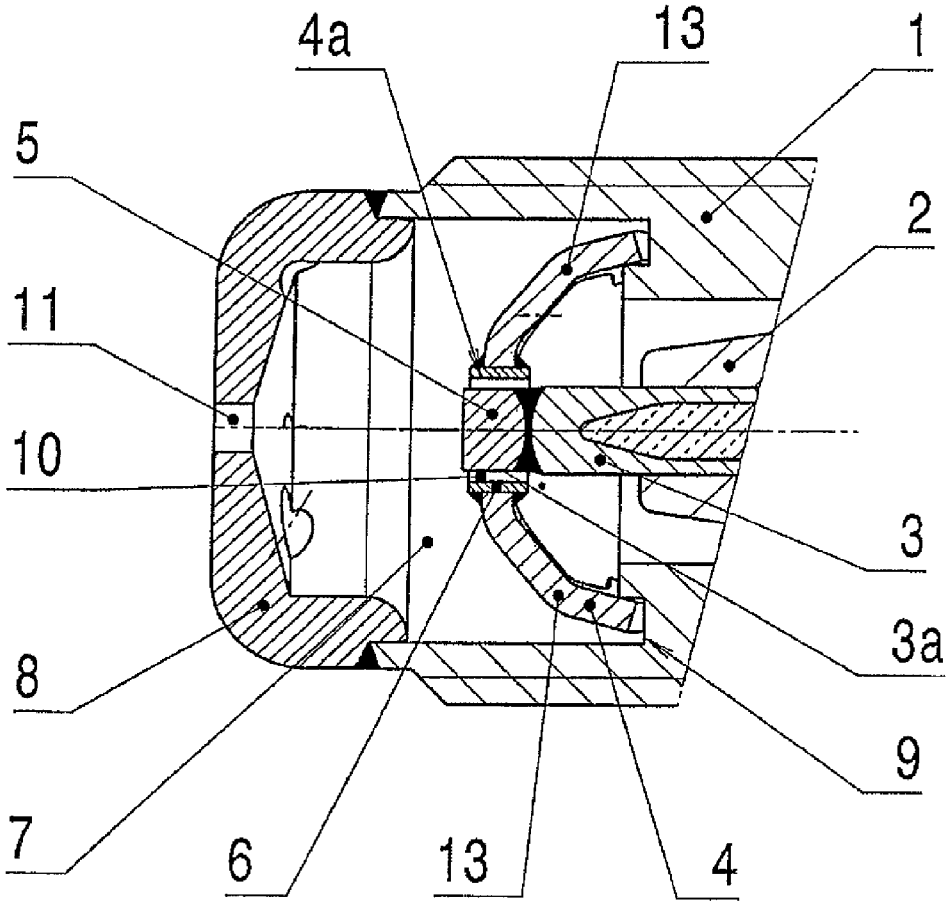
FIG. 1 shows a longitudinal section of a front section of a spark plug.
Figure 2:
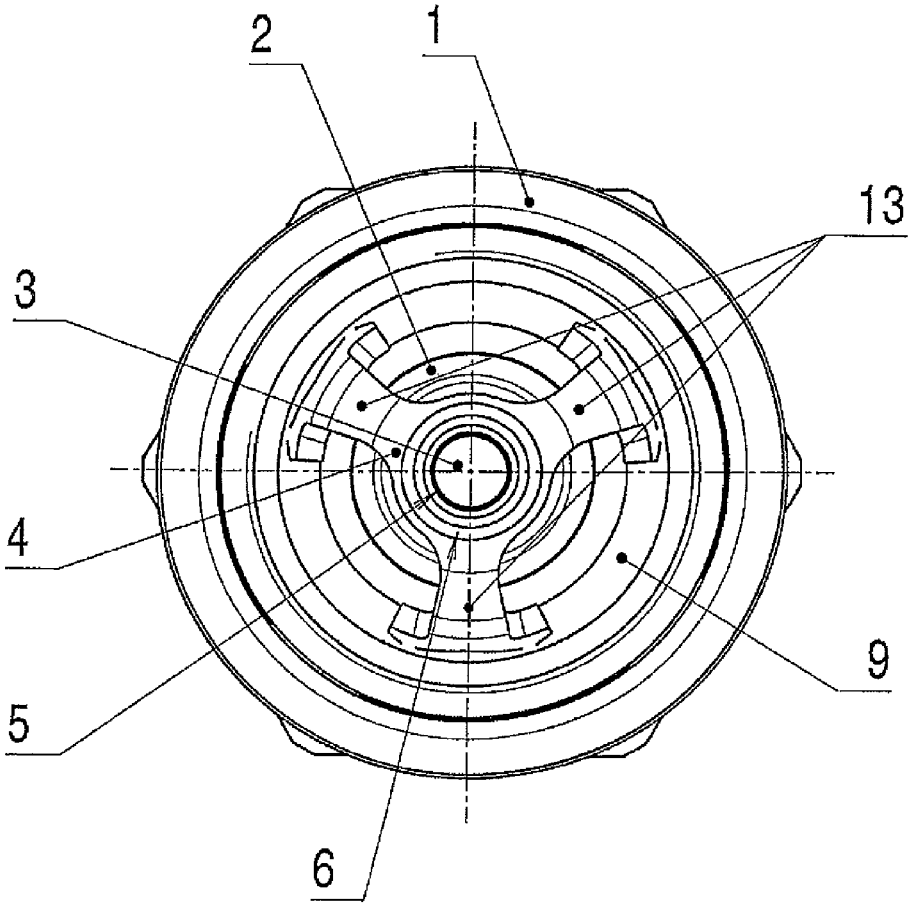
FIG. 2 shows a front view of the spark plug from FIG. 1.

FIGS. 1 and 2 show a spark plug according to the invention, which substantially comprises a metallic body 1, a ceramic insulator 2, a central electrode 3, an ground electrode 4, and a cap 8. The cap 8 is connected to the metallic body 1 by a weld and, together with the same, forms an ante-chamber 7, in which the central electrode 3 and the ground electrode 4 are disposed. The end of the central electrode 3 is provided with a cylindrical precious metal piece 5, in particular by welding. The ground electrode 4 has an annular design and is lined with a cylindrical sleeve 6 made of precious metal or a precious metal alloy. The ground electrode 4, together with the cylindrical precious metal piece 5 of the central electrode 3, forms an annular ignition gap 10, in which the ignition sparks can spark over.

The cylindrical lateral surfaces 3*a* and 4*a* of the central electrode 3 and of the ground electrode 4 are produced with high accuracy and are coaxially disposed with high accuracy.

The ground electrode 4 is shown in a top view in FIG. 2; it is rigidly connected by way of three legs 13, which are disposed in a star shape and have an arcuate course, to the metallic body 1 of the spark plug, in that the three legs 13 are accommodated in an annular groove 9 at the front edge of the metallic body 1 and welded to the body 1.

The spark gap of the spark plug is formed by the cylindrical lateral surface 3*a* of the precious metal piece 5 of the central electrode 3 and by the inner cylindrical surface 4*a* of the precious metal sleeve 6 of the ground electrode 4. The cylindrical lateral surface 3*a* of the precious metal piece 5 of the central electrode 3 is at least 15 $mm^2$. The opposing precious metal sleeve 6 of the ground electrode 4 has a cylindrical inner surface of at least 17 $mm^2$. Both surfaces are available for the burn-off.

In the direction of the central electrode 3, the cap 8 comprises a borehole 11, through which an ignitable gas-air mixture is introduced in the ante-chamber 7 during a compression stroke of an internal combustion engine, where it is ignited by way of an ignition spark.

The configuration of the ground electrode 4 with the three legs 13 thereof ensures that the annular ignition gap 10 between the central electrode 3 and the ground electrode 4 is easily accessible. Once the mixture in the ante-chamber 7 has been ignited, the flame is thrown through the borehole 11 out of the ante-chamber 7 into the main combustion chamber of the internal combustion engine as a result of the combustion pressure and ignites the fuel-air mixture present there.

Figure 3:
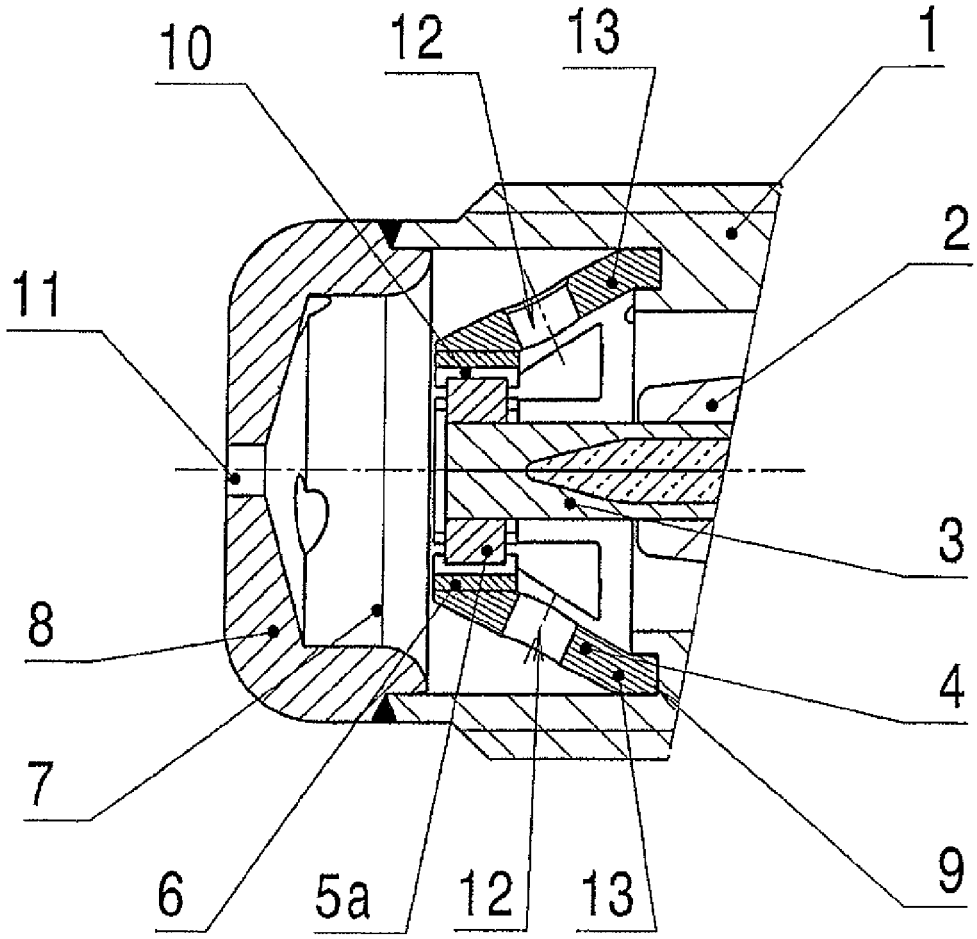
FIG. 3 shows a second embodiment of a spark plug according to the invention in a sectional view according to FIG. 1.

The embodiment illustrated in FIG. 3 differs from the embodiment shown in FIGS. 1 and 2 in that the central electrode 3 has a mushroom shape, wherein a ring 5*a* made of a precious metal or a precious metal alloy is pushed onto the end of the central electrode 3 that is otherwise made of a base metal and welded thereto. In this way, a larger electrode surface is produced, which according to the invention results in a longer service life because more electrode material is available for burn-off. A circulating borehole, which promotes the flow of the gas-air mixture around the central electrode 3, is provided in each leg 13 of the ground electrode 4.

Using the design shown in FIG. 3, electrode surfaces made of precious metal or made of a precious metal alloy can be achieved, which have a size of 40 $mm^2$ or more and which are available for the burn-off under the action of the ignition sparks.

LIST OF REFERENCE NUMERALS

1 body
2 insulator
3 central electrode
3*a* cylindrical lateral surface
4 ground electrode
4*a* cylindrical lateral surface
5 precious metal piece
5*a* ring
6 precious metal sleeve
7 ante-chamber
8 cap
9 annular gap
10 Ignition gap
11 borehole, opening
12 circulating borehole
13 three legs

What is claimed is:

1. A spark plug for a gas-fired internal combustion engine, the spark plug comprising:

a metallic body;

an insulator fastened in the body;

a central electrode leading through the insulator and having a solid piece made from a precious metal or a precious metal alloy attached at an end of the central electrode and protruding beyond the insulator, the solid piece having a cylindrical surface, a center point, and a longitudinal axis where the cylindrical surface circumferentially extends around the center point of the solid piece and the longitudinal axis is aligned with the center point of the solid piece, wherein the cylindrical surface of the solid piece is an abrasively ground surface;

a ground electrode fastened to the body and having an annular sleeve made from a precious metal or precious metal alloy and surrounding the solid piece of the central electrode, the annular sleeve having an inner cylindrical surface, a center point, and a longitudinal axis where the inner cylindrical surface circumferentially extends around the center point of the annular sleeve and the longitudinal axis is aligned with the center point of the annular sleeve, wherein the inner cylindrical surface of the annular sleeve is a drawn surface and the mutually facing cylindrical surfaces of the solid piece and the annular sleeve are coaxially disposed cylinder surfaces; and a cap attached to the body for shielding the central electrode and the ground electrode upon installation of the spark plug into a combustion chamber of the internal combustion engine and together with the body of the spark plug forming an ante-chamber for receiving the central electrode and the ground electrode, the cap having at least one opening for enabling a gas exchange between the ante-chamber and a space outside of the ante-chamber, wherein a deviation between the center point of the solid piece and the center point of the annular sleeve is less than +−20 μm, and a deviation between a position of the longitudinal axis of the solid piece and a position of the longitudinal axis of the annular sleeve is less than +−50 μm.

2. The spark plug according to claim 1, wherein a deviation of the width of an annular gap, measured in the radial direction, between the mutually opposing cylinder surfaces is less than +−75 μm.

3. The spark plug according to claim 1, wherein a roughness of the mutually opposing cylinder surfaces of the solid piece and the annular sleeve is no more than 1.6 μm.

4. The spark plug according to claim 1, wherein the central electrode and the ground electrode are provided with platinum or iridium, or with a platinum alloy or with an iridium alloy.

5. The spark plug according to claim 1, wherein the annular gap between the two cylinder surfaces of the solid piece and the annular sleeve is 0.2 mm to 0.5 mm.

6. The spark plug according to claim 1, wherein the diameter of the solid piece is 2 mm to 8 mm.

7. The spark plug according to claim 1, wherein the size of the cylinder surface of the solid piece is at least 15 $mm^2$.

8. The spark plug according to claim 1, wherein the size of the cylinder surface of the solid piece is at least 30 $mm^2$.

9. The spark plug according to claim 1, wherein the size of the cylinder surface of the solid piece is at least 40 $mm^2$.

10. The spark plug according to claim 1, wherein the solid piece and the annular sleeve are made from a platinum-based alloy or an iridium-based alloy.

11. The spark plug according to claim 1 wherein the annular gap between the two cylinder surfaces of the solid piece and the annular sleeve is 0.25 mm to 0.35 mm.

12. A spark plug for a gas-fired internal combustion engine, the spark plug comprising:

a metallic body;

an insulator fastened in the metallic body;

a central electrode fastened in the insulator and having a precious metal piece made of a precious metal or precious metal alloy, the precious metal piece has an outer cylindrical surface that extends circumferentially around the outside of the precious metal piece, wherein the outer cylindrical surface that extends circumferentially around the outside of the precious metal piece is abrasively ground to a roughness of no more than 1.6 μm;

a ground electrode fastened on the metallic body and having a precious metal sleeve made of a precious metal or precious metal alloy, the precious metal sleeve surrounds the precious metal piece and has an inner cylindrical surface that extends circumferentially around the inside of the precious metal sleeve, and the inner cylindrical surface of the precious metal sleeve opposes the outer cylindrical surface of the precious metal piece across an annular ignition gap; and a cap fastened on the metallic body and having a borehole, the cap and the metallic body form an ante-chamber that exchanges a gas-air mixture with a combustion chamber via the borehole upon installation of the spark plug in an internal combustion engine, and the annular ignition gap is located within the ante-chamber so that the gas-air mixture is ignited at the annular ignition gap within the ante-chamber;

wherein the precious metal piece of the central electrode and the precious metal sleeve of the ground electrode are coaxial with one another so that a deviation of a width of the annular ignition gap, measured in a radial direction, between the inner cylindrical surface of the precious metal sleeve and the outer cylindrical surface of the precious metal piece is less than ±75 μm.

13. The spark plug according to claim 12, wherein the borehole is coaxial with the precious metal piece of the central electrode and the precious metal sleeve of the ground electrode.

14. The spark plug according to claim 12, wherein the ground electrode and the central electrode are recessed within an end of the metallic body so that the annular ignition gap does not extend beyond the end of the metallic body.

15. The spark plug according to claim 12, wherein the precious metal piece of the central electrode is a solid disc attached to a distal end of the central electrode, and an axial length of the outer cylindrical surface of the central electrode precious metal piece is larger than an axial length of the inner cylindrical surface of the ground electrode precious metal sleeve.

16. The spark plug according to claim 12, wherein the precious metal piece of the central electrode is a ring and is attached to an outside of the central electrode, and an axial length of the outer cylindrical surface of the central electrode precious metal piece is smaller than an axial length of the inner cylindrical surface of the ground electrode precious metal sleeve.

17. The spark plug according to claim 12, wherein the precious metal sleeve of the ground electrode is rigidly connected to the metallic body with three legs, the three legs being disposed in a star shape and having an arcuate course.

18. The spark plug according to claim 17, wherein each of the three legs has a circulating borehole that is arranged to promote the flow of the gas-air mixture around the central electrode.

* * * * *